US010770825B2

(12) United States Patent
Durse et al.

(10) Patent No.: US 10,770,825 B2
(45) Date of Patent: Sep. 8, 2020

(54) ELECTRICAL CONTACT SPRING AND ELECTRICAL ASSEMBLY INCLUDING SAME

(71) Applicant: Aptiv Technologies Limited, St. Michael (BB)

(72) Inventors: Nicholas A. Durse, Youngstown, OH (US); Adam Wolfgang, Petersburg, OH (US); Michael L. Mellott, Youngstown, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/593,113

(22) Filed: Oct. 4, 2019

(65) Prior Publication Data

US 2020/0136301 A1 Apr. 30, 2020

Related U.S. Application Data

(60) Provisional application No. 62/749,926, filed on Oct. 24, 2018.

(51) Int. Cl.

| | |
|---|---|
| ***H01R 13/514*** | (2006.01) |
| ***H01R 43/20*** | (2006.01) |
| ***H01R 13/6599*** | (2011.01) |
| ***H01R 13/6585*** | (2011.01) |
| ***H01R 9/05*** | (2006.01) |

(52) U.S. Cl.

CPC ..... *H01R 13/514* (2013.01); *H01R 9/0527* (2013.01); *H01R 13/6585* (2013.01); *H01R 13/6599* (2013.01); *H01R 43/20* (2013.01)

(58) Field of Classification Search

CPC ..... H01R 13/514; H01R 13/6585; H01R 13/6599; H01R 43/20; H01R 9/0527

USPC ..... 439/607.2

See application file for complete search history.

(56) References Cited

U.S. PATENT DOCUMENTS

| | | | | |
|---|---|---|---|---|
| 3,897,125 | A | 7/1975 | Anderson | |
| 4,659,869 | A | 4/1987 | Busby | |
| 4,812,137 | A | 3/1989 | Wilson et al. | |
| 7,575,487 | B2 * | 8/2009 | Yodogawa | H01R 13/113 439/830 |
| 7,794,257 | B2 | 9/2010 | Rozet et al. | |
| 8,113,859 | B2 * | 2/2012 | Kim | H01R 33/02 439/239 |

(Continued)

*Primary Examiner* — Harshad C Patel

(74) *Attorney, Agent, or Firm* — Billion & Armitage Robert Myers

(57) ABSTRACT

An electrical assembly includes a planar first member formed of a first electrically conductive material defining an aperture therethrough. The assembly also includes a second member distinct from the first member that is formed of a second electrically conductive material. The assembly further includes a contact spring formed of a third electrically conductive material disposed within the aperture. The contact spring is in physical and electrical contact with the first and second members. The contact spring has a planar base portion, an arcuate portion extending from the base portion in contact with the second member, and two winged portions extending from distal edges of the base portion. The two winged portions flank the base portion. Each of the two winged portions are in contact with an inner surface of the aperture.

8 Claims, 7 Drawing Sheets

(56) References Cited

U.S. PATENT DOCUMENTS

| | | | | |
|---|---|---|---|---|
| 8,147,256 | B2 * | 4/2012 | Jin | H01R 12/52 439/83 |
| 8,317,529 | B2 * | 11/2012 | Katano | H01R 13/115 439/251 |
| 8,766,123 | B2 * | 7/2014 | Hu | H01H 13/14 200/345 |
| 8,827,729 | B2 | 9/2014 | Gunreben et al. | |
| 8,882,543 | B2 | 11/2014 | Pabst et al. | |
| 8,925,089 | B2 | 12/2014 | Sallam | |
| 9,099,814 | B2 | 8/2015 | Snader et al. | |
| 9,379,478 | B2 | 6/2016 | Fabre et al. | |
| 9,431,771 | B1 | 8/2016 | Sundarakrishnamachari et al. | |
| 9,667,000 | B1 | 5/2017 | Morello et al. | |
| 9,762,001 | B2 | 9/2017 | Morello et al. | |
| 10,038,270 | B2 | 7/2018 | Fabre et al. | |
| 2004/0161979 | A1 * | 8/2004 | Kyowski | H01R 11/282 439/660 |
| 2004/0235316 | A1 * | 11/2004 | Liao | H01R 13/2435 439/66 |
| 2006/0030191 | A1 * | 2/2006 | Tuin | H01R 13/14 439/246 |
| 2007/0178719 | A1 * | 8/2007 | Mendenhall | H01R 12/7076 439/66 |
| 2010/0173540 | A1 * | 7/2010 | Lee | H01R 13/112 439/861 |
| 2011/0227471 | A1 * | 9/2011 | Richard | H01J 9/34 313/113 |

* cited by examiner

ELECTRICAL CONTACT SPRING AND ELECTRICAL ASSEMBLY INCLUDING SAME

CROSS-REFERENCE TO RELATED APPLICATION

This application claims the benefit under 35 U.S.C. § 119(e) of U.S. Provisional Patent Application No. 62/749,926 filed on Oct. 24, 2018, the entire disclosure of which is hereby incorporated by reference.

TECHNICAL FIELD OF THE INVENTION

The invention generally relates to an electrical contact spring and an electrical assembly including such as contact spring.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
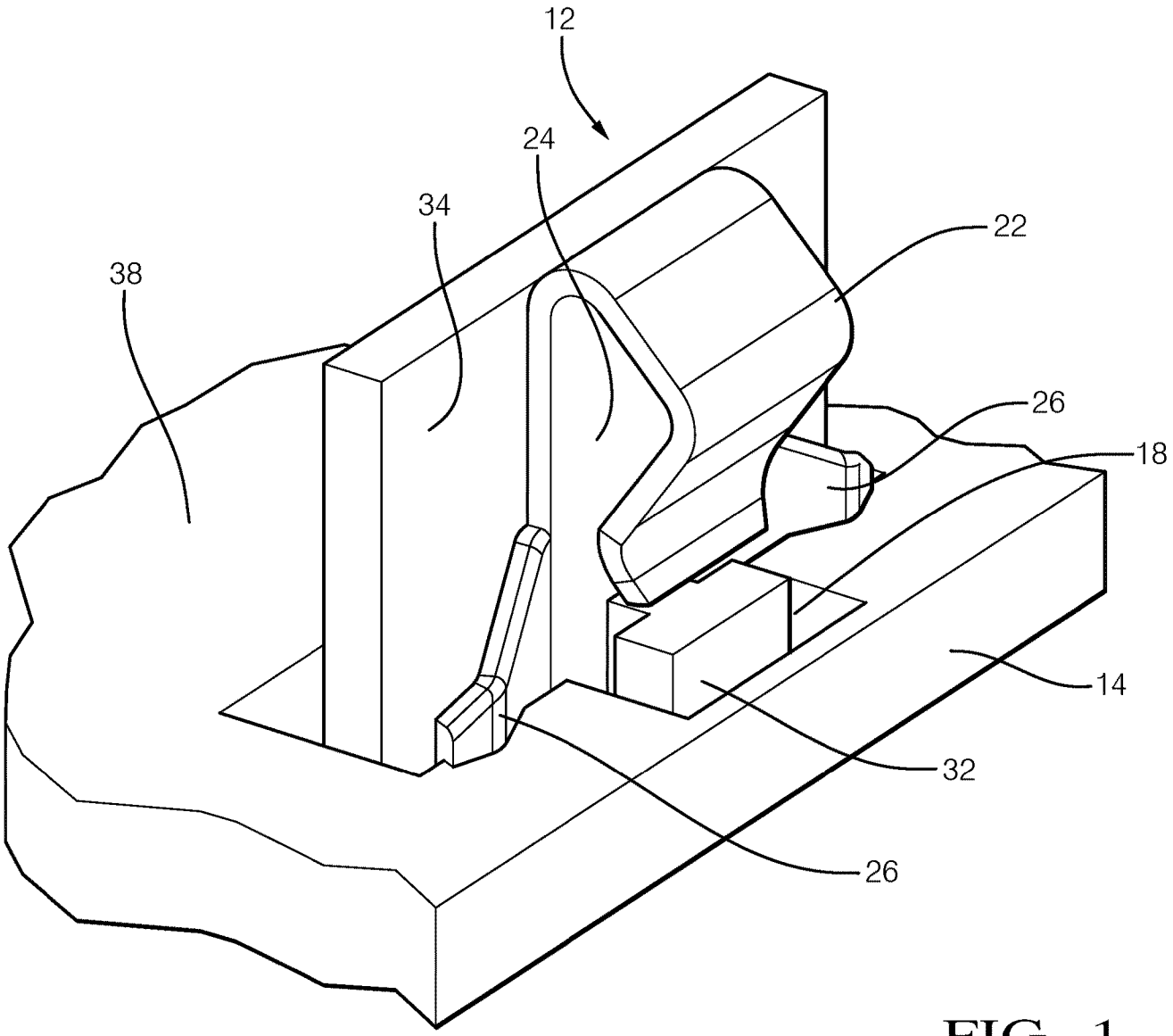
FIG. 1 is a perspective view of an electrical contact spring, according to one embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Electrophoretic painting processes, commonly known as e-coating, has become a preferred method for providing corrosion protection for sheet metal parts, such as the metal cases of battery packs or other electronic assemblies. However, the e-coating electrically isolates one metallic part, such as a base plate from another metallic part, such as a cover attached to the base plate. The base plate and the cover are preferably electrically connected to one another so that they can provide electromagnetic shielding for the electronic devices within. The electrical contact spring presented herein is configured to penetrate the e-coating so that the electrical contact spring is in electrical contact with the metal beneath the e-coating in order to provide proper electromagnetic shielding.

FIGS. 1 through 7 illustrate an embodiment of an electrical assembly, hereinafter referred to as the assembly 10 including an electrical contact spring, hereinafter referred to as the contact spring 12, that is connected to a planar first member 14 that is formed of a first electrically conductive material, e.g. a metal base plate of a battery pack and provide an electrical connection to a second member 16 that is distinct from the first member 14 and formed of a second electrically conductive material, e.g. a metal cover of a battery pack. The first and second conducive materials may be a metallic material, such as an aluminum alloy, or may be a conductive plastic. The first and second conductive materials may be the same material or they may be different materials.

Figure 5:
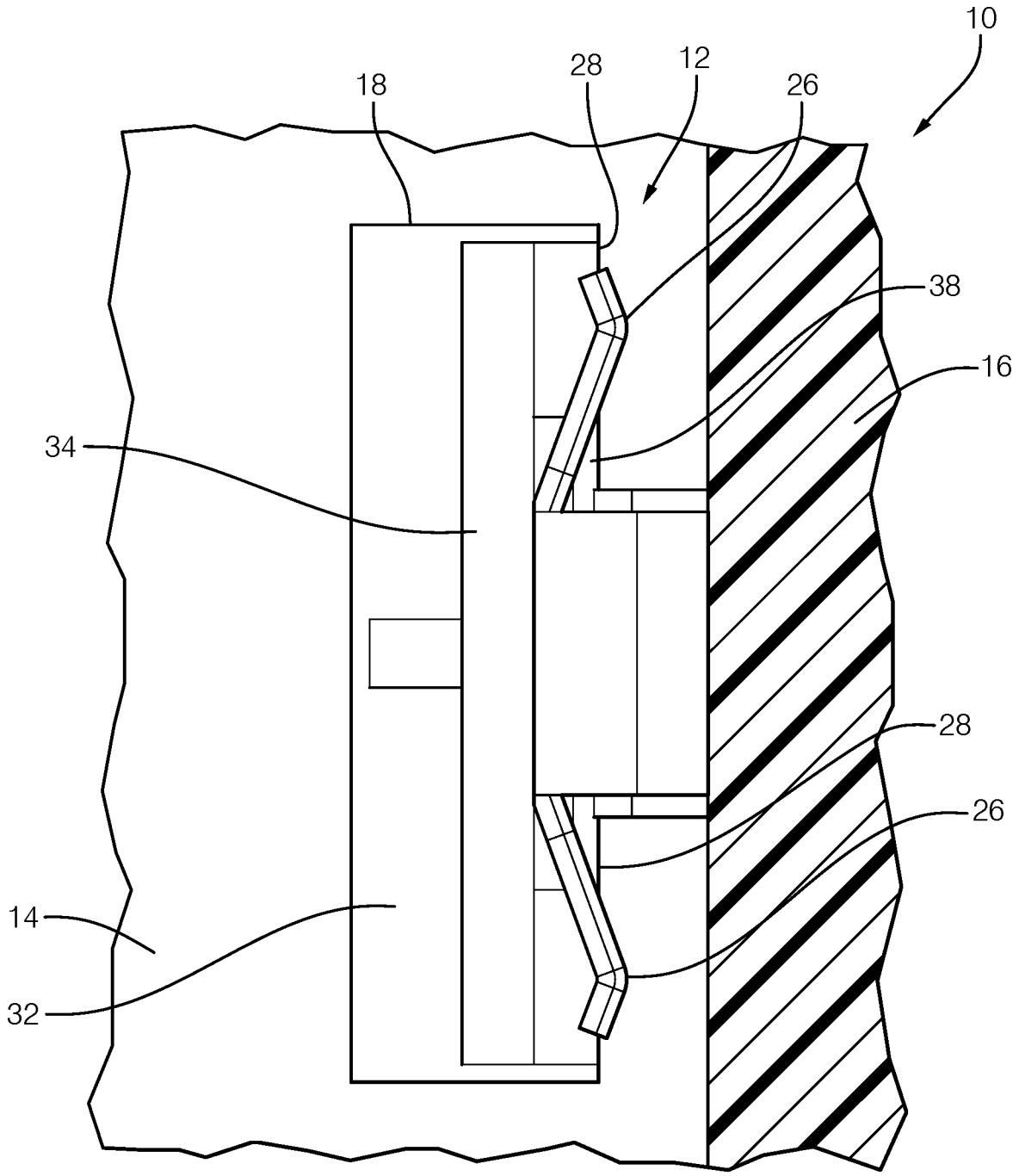
FIG. 5 is a top view of the electrical assembly of FIG. 4, according to one embodiment of the invention.

As shown in FIG. 1, the assembly 10 includes a contact spring 12 that is formed of a third electrically conductive material. The contact spring 12 is disposed within a T-shaped aperture 18 extending through the first member 14. As best shown in FIG. 5, the contact spring 12 is in physical and electrical contact with the first and second members 14, 16. The contact spring 12 has a planar base portion 20, an arcuate portion 22 extending from the base portion 20 in contact with the second member 16, and two winged portions 24 extending from distal edges 26 of the base portion 20 that flank the base portion 20.

Figure 2:
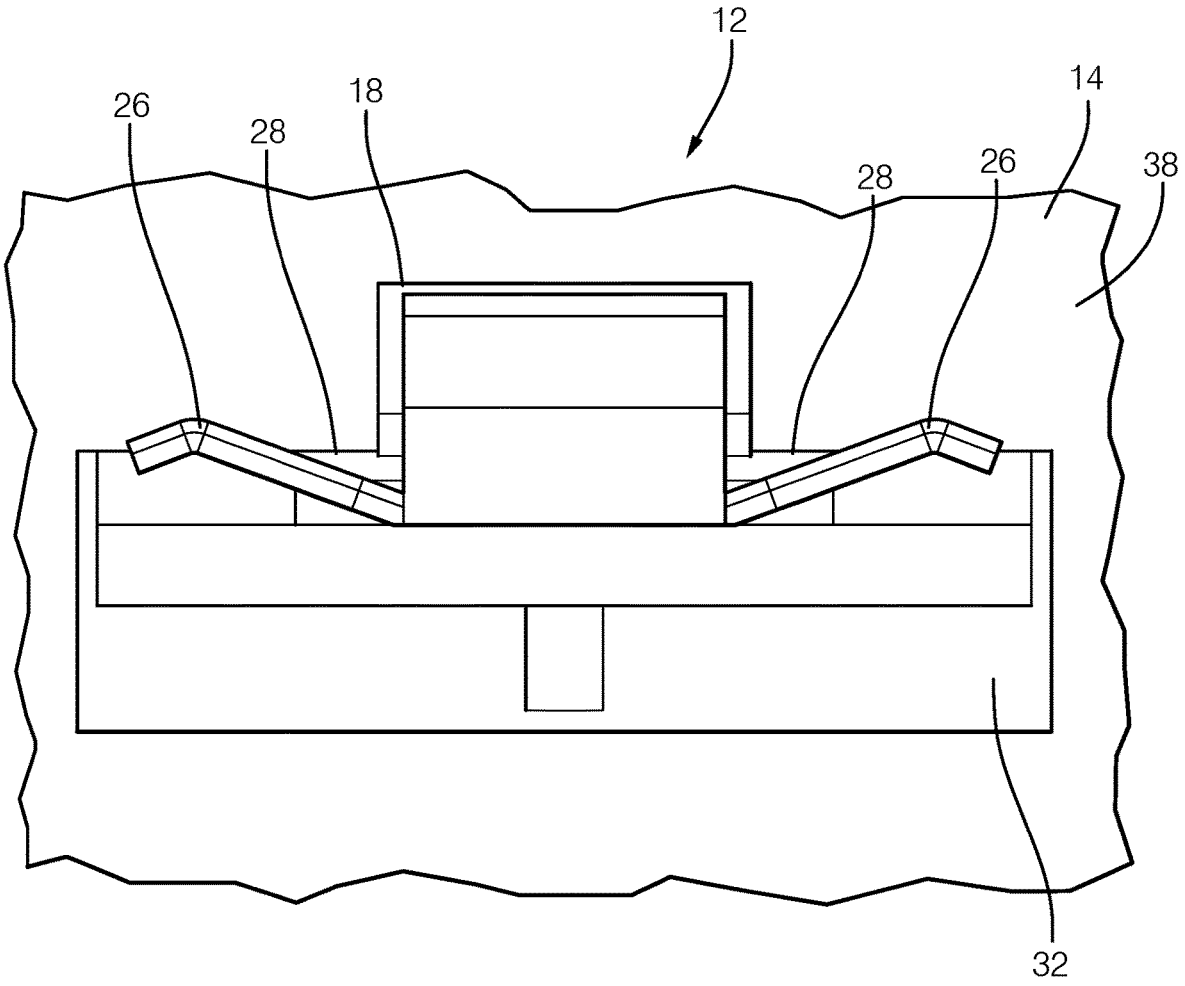
FIG. 2 is a top view of the electrical contact spring of FIG. 1, according to one embodiment of the invention.
Figure 3:
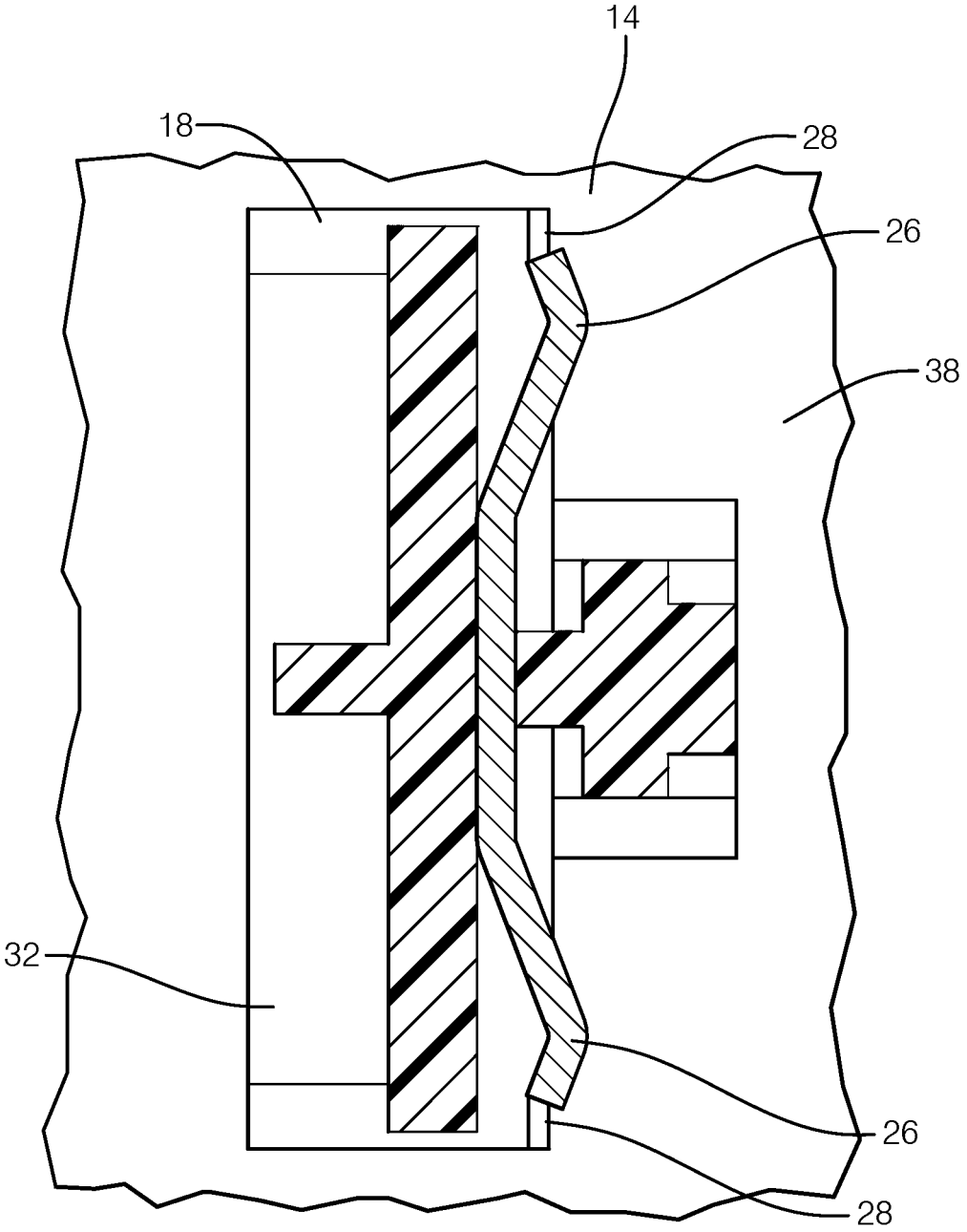
FIG. 3 is a cross section top view of the electrical contact spring of FIG. 1, according to one embodiment of the invention.
Figure 4:
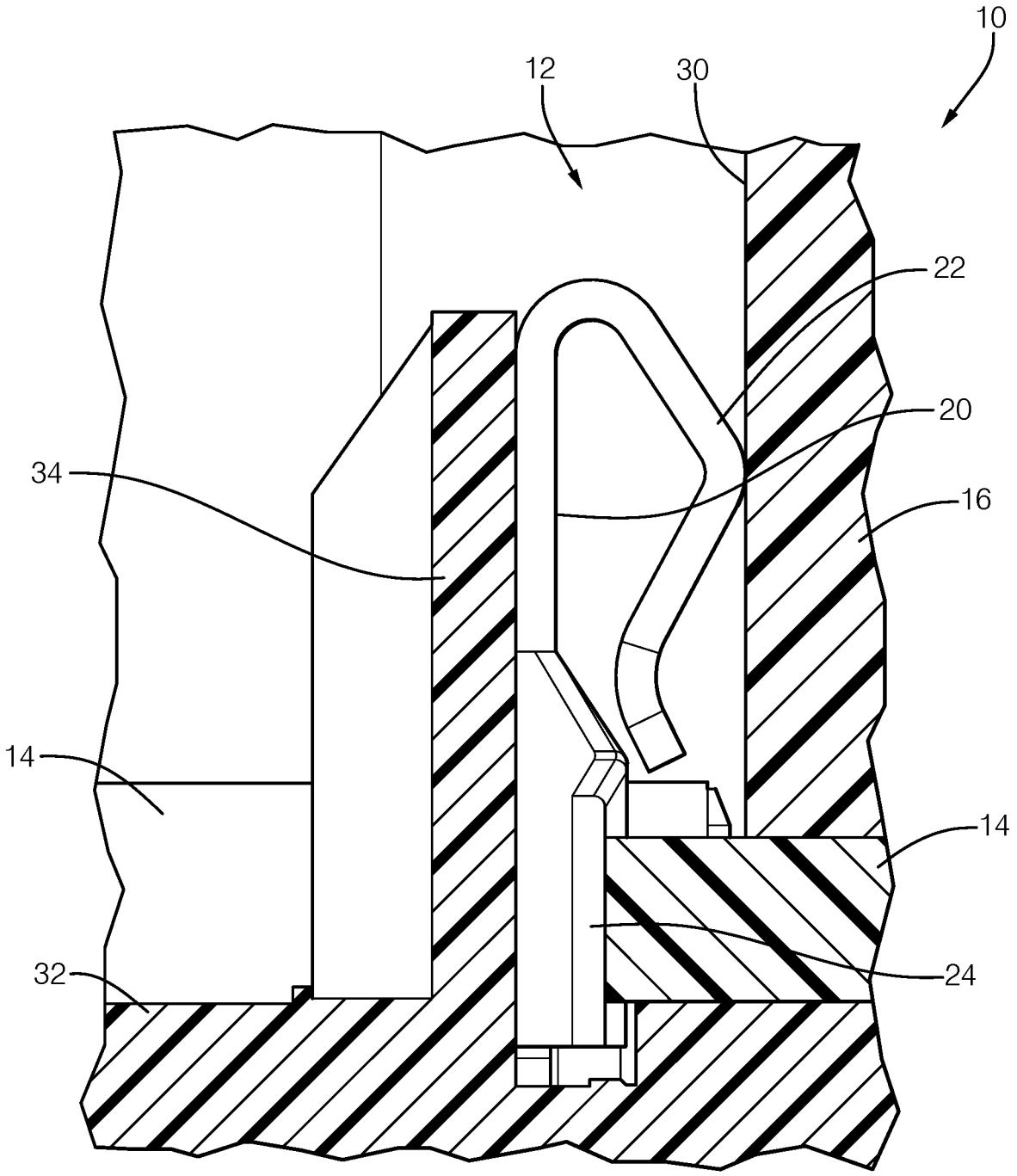
FIG. 4 is a side view of an electrical assembly including the electrical contact spring of FIG. 1, according to another embodiment of the invention.

As illustrated in FIGS. 2 and 3, each of the two winged portions 24 are in contact with an inner surface 28 of the aperture 18. As shown in FIG. 4, the arcuate portion 22 of the contact spring 12 is in contact with a conductive inner surface 30 of the second member 16.

Figure 6:
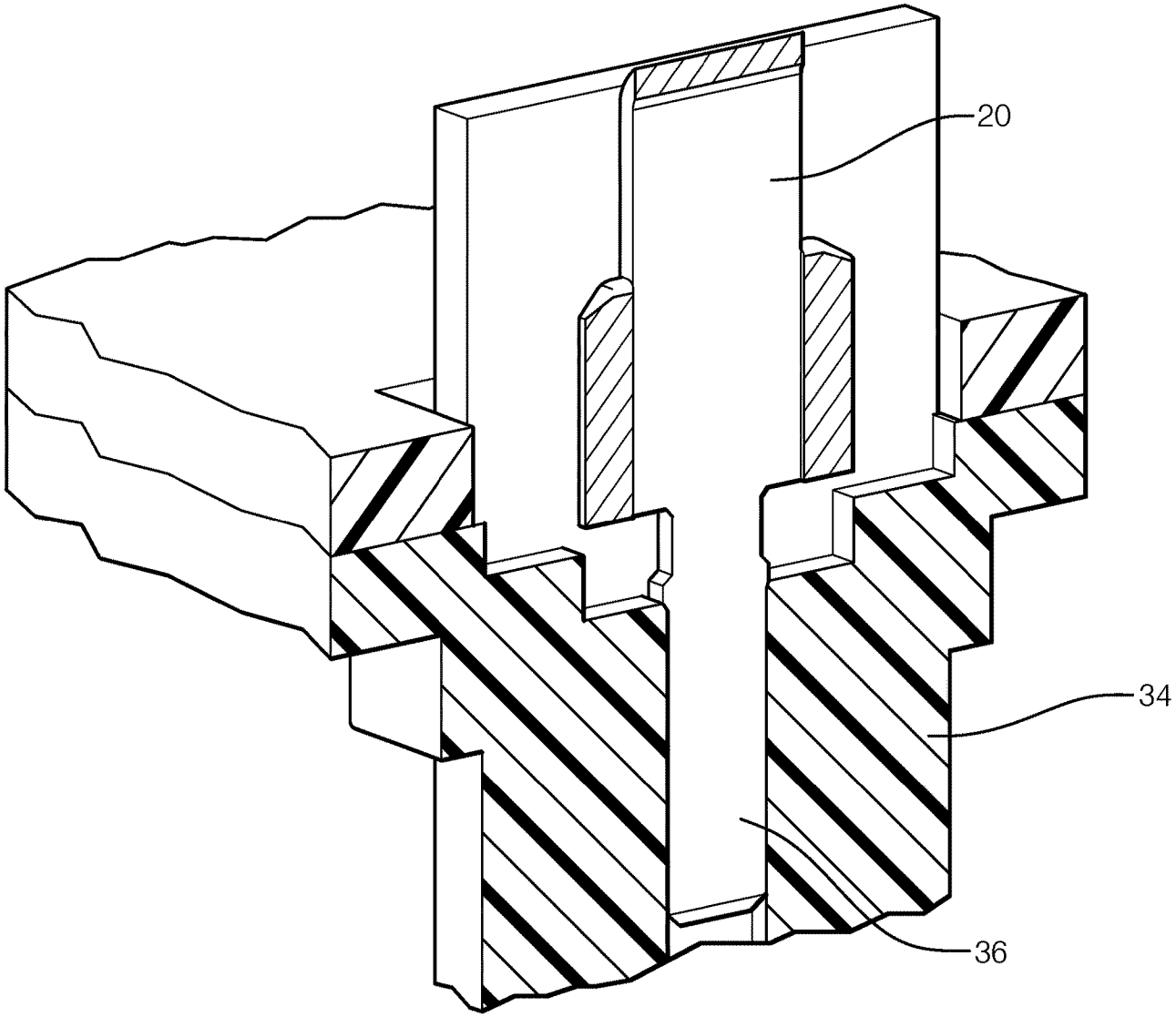
FIG. 6 is a cross section perspective view of the electrical assembly of FIG. 4, according to one embodiment of the invention.

FIG. 1 also shows that the assembly 10 further includes a support member 32 that protrudes through the aperture 18 with the contact spring 12. The support member 32 may be part of a plastic header. The support member 32 has a planar segment 34 that is in physical contact with the base portion 20 of the contact spring 12. The base portion 20 of the contact spring 12 and the planar segment 34 of the support member 32 is generally perpendicular to the planar first member 14. As shown in FIG. 6, the contact spring 12 defines an elongate tail 36 that is disposed within the support member 32.

The first member 14 is coated with an electrically nonconductive material 38, such as a paint applied using an e-coating processes. The two winged portions 24 scratch through the electrically nonconductive material 38 down to the first electrically conductive material as the contact spring 12 is inserted within the aperture 18 and provide a compressive normal force against the first member 14, thereby providing electrical contact between the first electrically conductive material of the first member 14 and the contact spring 12. Testing by the inventors has shown that reliably scraping through the e-coating preferably requires a wiping, linear motion rather than a compressive motion. The contact points between the two winged portions 24 and the first member 14 are in the thickness of the first member 14 rather than the flat top or bottom surface of the first member 14. The contact spring 12 eliminates the need for masking a portion of the first member 14 during the e-coating process to provide a conductive surface.

Figure 7:
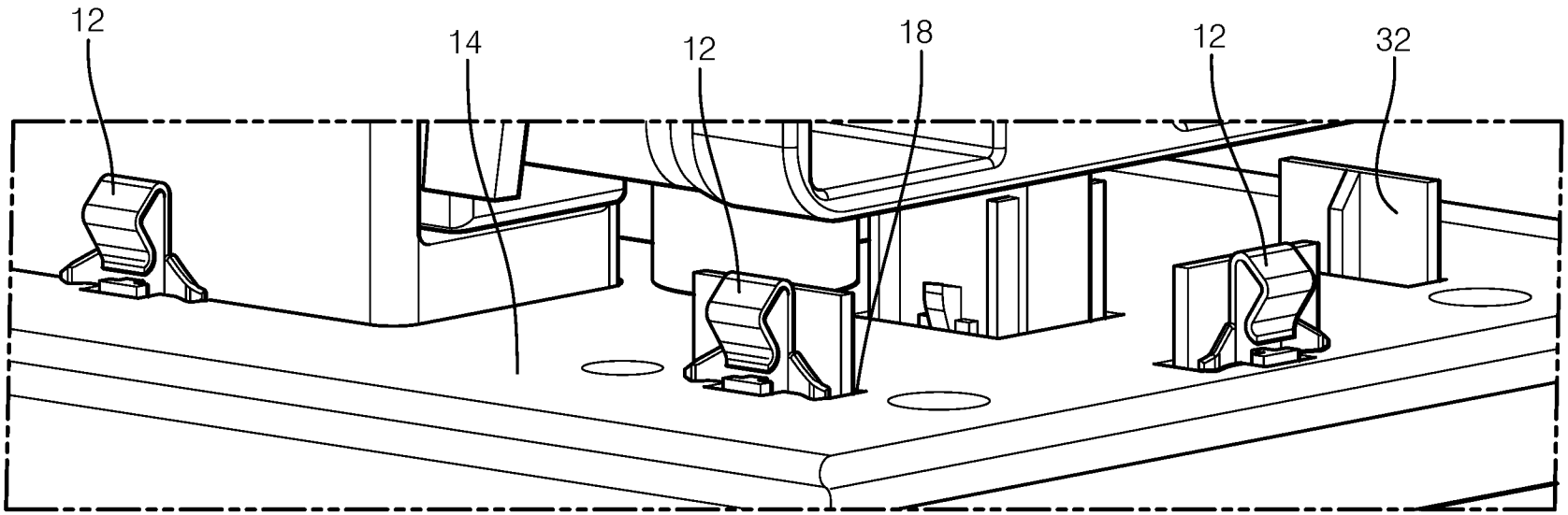
FIG. 7 is a partial perspective view of the electrical assembly of FIG. 4, according to one embodiment of the invention.

As shown in FIG. 7, a number of contact springs 12 can be placed around the header since they are loose piece components and do not need to be mechanically connected to each other.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical assembly, comprising:

a planar first member formed of a first electrically conductive material defining an aperture therethrough;

a second member distinct from the first member and formed of a second electrically conductive material; and a contact spring formed of a third electrically conductive material disposed within the aperture and in physical and electrical contact with the first and second members, said contact spring having a planar base portion, an arcuate portion extending from the base portion in contact with the second member, and two winged portions extending from distal edges of the base portion and flanking the base portion, each of the two winged portions being in contact with an inner surface of the aperture.

2. The electrical assembly according to claim 1, wherein the first member is coated with an electrically nonconductive material and wherein the two winged portions scratch through the electrically nonconductive material as the contact spring is inserted within the aperture, thereby providing electrical contact between the first electrically conductive material of the first member and the contact spring.

3. The electrical assembly according to claim 2, wherein the first member is coated with the electrically nonconductive material using an electrophoretic painting process.

4. The electrical assembly according to claim 1, wherein the base portion of the contact spring is generally perpendicular to the planar first member.

5. The electrical assembly according to claim 1, wherein the assembly further comprises a support member having a planar segment in physical contact with the base portion of the contact spring.

6. The electrical assembly according to claim 5, wherein the contact spring defines an elongate tail that is disposed within the support member.

7. The electrical assembly according to claim 1, wherein the aperture is T-shaped.

8. The electrical assembly according to claim 1, wherein the aperture is cross-shaped.

* * * * *